US009815662B1

(12) United States Patent
Chien

(10) Patent No.: US 9,815,662 B1
(45) Date of Patent: Nov. 14, 2017

(54) CYLINDRICAL PAPER BOBBIN FOR WINDING YARNS

(71) Applicant: NAN YA PLASTICS CORPORATION, Taipei (TW)

(72) Inventor: Yang-Doun Chien, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 0 days.

(21) Appl. No.: 15/263,521

(22) Filed: Sep. 13, 2016

(51) Int. Cl.
*B65H 75/10* (2006.01)
*B65H 75/30* (2006.01)

(52) U.S. Cl.
CPC ..... *B65H 75/10* (2013.01); *B65H 75/30* (2013.01); *B65H 2701/31* (2013.01)

(58) Field of Classification Search
CPC ..... B65H 75/10; B65H 75/105; B65H 75/14; B65H 75/30; B65H 54/42; B65H 2701/31
See application file for complete search history.

(56) References Cited

U.S. PATENT DOCUMENTS 1,458,587 A * 6/1923 McKean ..... B65H 54/42 242/118.32
1,597,230 A * 8/1926 Hartshorne ..... B65H 75/10 242/118.1
2,368,450 A * 1/1945 Crooks ..... B65H 75/10 242/118.32
4,760,976 A * 8/1988 Burchette, Jr. ..... B65H 54/34 242/118.11
5,465,916 A * 11/1995 Konig ..... B65H 54/34 242/125.1
6,595,456 B2 * 7/2003 Rummage ..... B65H 75/28 242/125.1

FOREIGN PATENT DOCUMENTS

IT WO 2004067427 A1 * 8/2004 ..... B29C 45/0001

* cited by examiner

*Primary Examiner* — William E Dondero
(74) *Attorney, Agent, or Firm* — Bacon & Thomas, PLLC

(57) ABSTRACT

A paper bobbin for winding yarn has an outer periphery provided with two annular protruding portions each adjacent to one of two ends of the paper bobbin respectively; since each protruding portion is protruded a height from the outer periphery of the paper bobbin, the two annular protruding portions may help the paper bobbin not only to lower the frequency of fiber breakage at initial stage of a yarn winding operation, but also to contribute to get a high quality of yarn and an increase in yield.

3 Claims, 2 Drawing Sheets

CYLINDRICAL PAPER BOBBIN FOR WINDING YARNS

BACKGROUND OF THE INVENTION

1. Field of the Invention

The present invention relates to a paper bobbin for yarn, and more particularly to a cylindrical paper bobbin having two annular protruding portions to protect a yarn being wound from fibers damaged, fluffs occurred or fiber breakage at initial stage of a yarn winding operation.

2. Description of Related Art

Referring to FIG. 1, a conventional paper bobbin 10 for winding yarns has a hollow cylindrical body 11, of which outer periphery (particularly in those areas respectively adjacent to the two ends of the hollow cylindrical body 11) has a smooth surface without any protruding structure.

To wind yarns around the paper bobbin 10, the paper bobbin 10 is mounted around a stationary shaft 30, and a frictional surface 41 of a rotary shaft 40 is brought into close contact with the outer periphery of the hollow cylindrical body 11 of the paper bobbin 10, as indicated by the circled area of "A" in FIG. 1.

Then, the rotary shaft 40 is rotated as a driving shaft such that the paper bobbin 10 is rotated along with the rotary shaft 40 by friction resulting from the rotating frictional surface 41. Once the tangential velocity of the outer periphery of the hollow cylindrical body 11 of the paper bobbin 10 reaches that of the frictional surface 41 of the rotary shaft 40, yarns are introduced and wound around the paper bobbin 10.

The paper bobbin 10 is a passive component to be rotated by the rotary shaft 40. When the frictional surface 41 of the rotary shaft 40 has a constant tangential velocity, the angular velocity of the paper bobbin 10 if rotated is in inverse proportion to the overall outer diameter of the paper bobbin 10 wound with yarns. As more and more layers of yarn are winding around the paper bobbin 10, so the angular velocity of the paper bobbin 10 is also slowed down as more significant.

At initial stage of a yarn winding operation, the overall outer diameter of the paper bobbin 10 wound with yarns is still relatively small; in other words, the overall outer diameter is imperceptible on the increase with the amount of yarn wound around the paper bobbin 10. During this stage of the yarn winding operation, the rotary shaft 40 therefore drives the paper bobbin 10 to be rotated at a very high angular velocity to carry out the yarn winding operation.

When wound at high speed, however, the yarn is pulled by a strong winding force as well as subject to a high tension. Resulted in that the yarn has fibers damaged or fluffs occurred, and more seriously, fiber breakage is often happened, repeatedly. Should any of these problems be occurred, the spinning process must be stopped to reconnect the yarn.

In addition, as the hollow cylindrical body 11 of the conventional paper bobbin 10 has a smooth outer periphery without any protruding structure, as shown in FIG. 1, a complete contact between the hollow cylindrical body 11 of the paper bobbin 10 and the frictional surface 41 of the rotary shaft 40 takes place at the initial stage of the yarn winding operation. And, because of the large area of contact, friction-based acceleration of the paper bobbin 10 generates noise as loud as 95 dB, which causes noise pollution in a spinning factory.

SUMMARY OF THE INVENTION

In light of the above, it is a primary object of the present invention to disclose a paper bobbin for winding yarn, comprising a hollow cylindrical body of which outer periphery has two annular protruding portions spaced apart at a distance; wherein each annular protruding portion is protruded from the outer periphery of the hollow cylindrical body to a height (H) ranging from 0.5 to 2.0 mm, preferably from 0.5 to 1.5 mm, and more preferably from 0.8 to 1.2 mm.

It is another objective of the present invention to disclose a paper bobbin for winding yarn, comprising a hollow cylindrical body of which outer periphery has two annular protruding portions spaced apart at a distance and two annular grooves spaced apart at a distance; wherein each annular protruding portion is protruded from the outer periphery of the hollow cylindrical body to a height (H) ranging from 0.5 to 2.0 mm, and each annular groove of the paper bobbin has a groove width (W) ranging from 4 to 15 mm, preferably from 4 to 12 mm, and more preferably from 4 to 8 mm.

The paper bobbin of the present invention produces the following advantageous effects at initial stage of a yarn winding operation, where the paper bobbin is driven by a high-speed rotary shaft to reel in yarn:

1. The tension of the yarn being wound is effectively reduced;
2. The yarn is protected from fiber breakage by high tension; or more particularly from fibers damaged or fluffs occurred;
3. The fibers of the yarn are less likely to break, meaning the quality and yield of the yarn can be ensured; and
4. The noise generated in the initial stage of the yarn winding operation is reduced, e.g., from about 95 dB to about 80 dB; thus, noise pollution in the spinning factory is ameliorated.

DETAILED DESCRIPTION OF THE INVENTION

Figure 2:
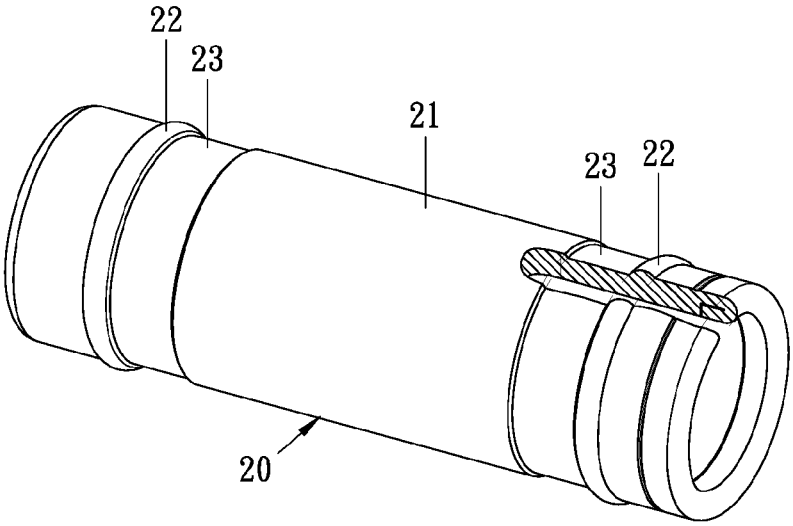
FIG. 2 is a partially sectional view of a cylindrical paper bobbin according to the present invention.
Figure 3:
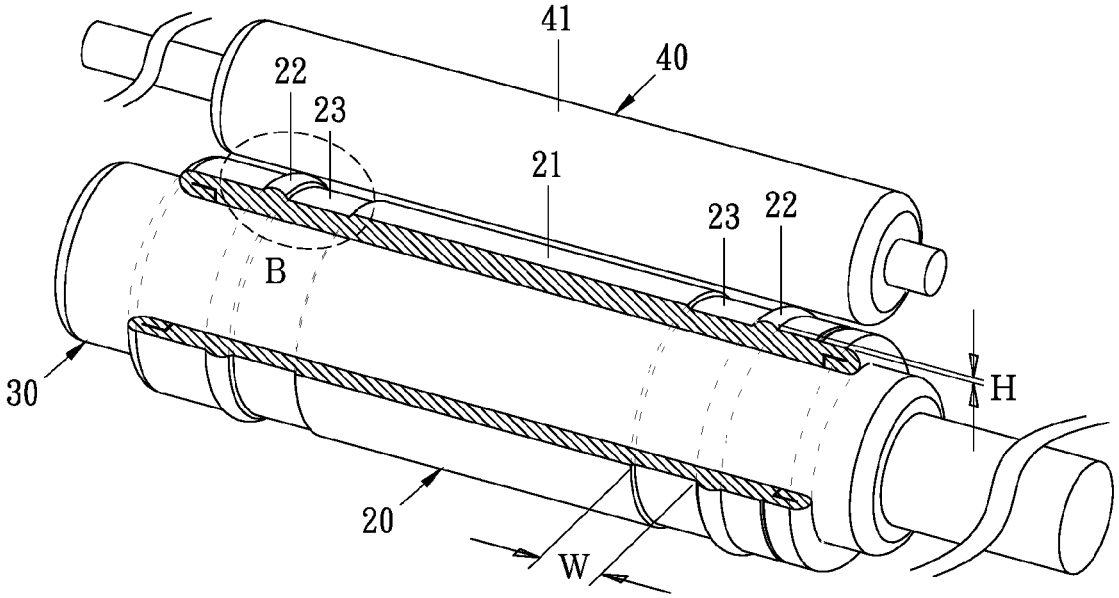
FIG. 3 is a partially sectional view to show how yarns are wound around the paper bobbin in FIG. 2.

As shown in FIG. 2 and FIG. 3, a paper bobbin 20 according to the present invention is disclosed to use in winding yarns, which includes a seamless hollow cylindrical body 21 formed by winding multiple layers of synthetic paper together. And particularly, a structural improvement on the paper bobbin 20 of the present invention is that an outer periphery of the hollow cylindrical body 21 is provided with two identical annular protruding portions 22 which are each other spaced apart at a distance.

One of the two annular protruding portions 22 is located the place adjacent to one end of the hollow cylindrical body 21, and the other is adjacent to the other end of the hollow cylindrical body 21, respectively.

Each annular protruding portion 22 is protruded from the outer periphery of the hollow cylindrical body 21 to a height (H) ranging from 0.5 to 2 mm, preferably from 0.5 to 1.5 mm, more preferably from 0.8 to 1.2 mm.

Figure 1:
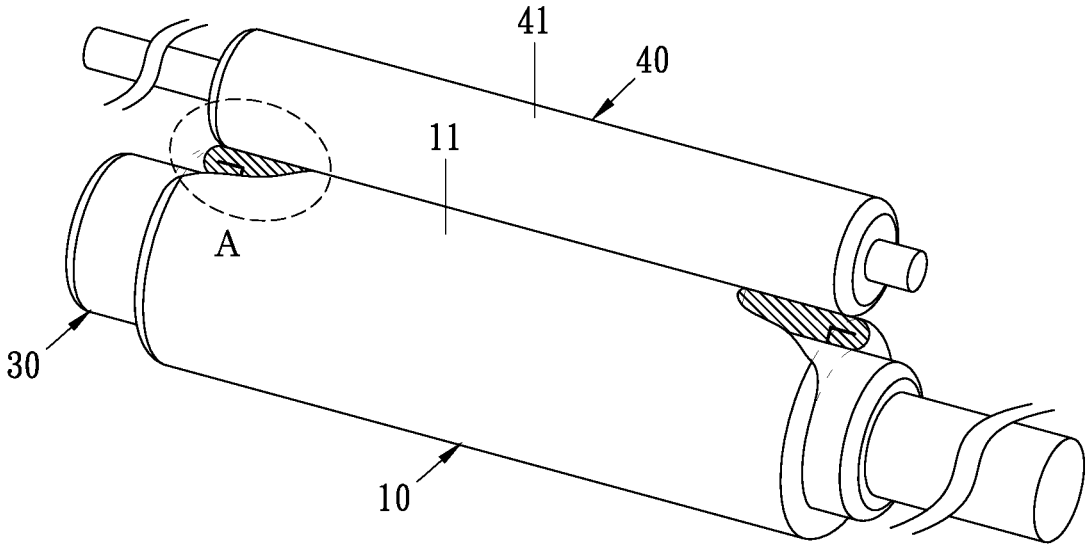
FIG. 1 (prior art)
FIG. 1 is a partially sectional view to show how yarns are wound around a conventional paper bobbin.

Accordingly, no matter the paper bobbin 20 of the present invention has the same outer diameter as that of the conventional paper bobbin 10 shown in FIG. 1, the outer diameter of the annular protruding portions 22 is still greater than the outer diameter of the hollow cylindrical body 11 of the conventional paper bobbin 10 by 0.5-2.0 mm. Therefore, at initial stage of a yarn winding operation, referring to the circled area of "B" in FIG. 3, only the top of each annular protruding portion 22 of the paper bobbin 20 of the present invention is in contact with the frictional surface 41 of the rotary shaft 40; in consequence, a frictional area generated between the paper bobbin 20 and the rotary shaft 40 is substantially smaller than that between the conventional paper bobbin 10 and the rotary shaft 40. This helps reduce noise pollution in a spinning factory by lowering the noise generated at the initial stage of the yarn winding operation from about 95 dB (when the conventional paper bobbin 10 is used) to about 80 dB.

More specifically, at the initial stage of a yarn winding operation, the paper bobbin 20 of the present invention contacts the rotary shaft 40 via the annular protruding portions 22, whose outer diameter is greater than that of the hollow cylindrical body 11 of the conventional paper bobbin 10 and which keep rotating at the same tangential velocity as the rotary shaft 40.

By contrast, the conventional paper bobbin 10 contacts the rotary shaft 40 via the hollow cylindrical body 11, whose outer diameter is smaller than that of the annular protruding portions 22 of the paper bobbin 20 of the present invention. Hence, when driven by the rotary shaft 40 at the same tangential velocity, the paper bobbin 20 of the present invention has a much lower angular velocity at the initial stage of a yarn winding operation than the conventional paper bobbin 10 has, and this helps reduce the winding force (or tension) with which the yarn is reeled in. Thus, the annular protruding portions 22 keep the yarn being wound from fibers damaged, fluffs occurred or fiber breakage at the initial stage of a yarn winding operation.

Referring to FIG. 1, yarn is wound around the conventional paper bobbin 10 by moving spirally back and forth between the two ends of the hollow cylindrical body 11 of the paper bobbin 10; as a result, the two ends of the hollow cylindrical body 11 of the conventional paper bobbin 10 are the mostly frequently wound portions. This phenomenon tends to deform the conventional paper bobbin 10 and cause high-tension damage to the yarn at the two ends of the hollow cylindrical body 11.

To solve these problems, referring to FIG. 2 and FIG. 3, another structural improvement on the aforesaid paper bobbin 20 of the present invention is that, in addition to having the two annular protruding portions 22, the paper bobbin 20 further provides two identical annular grooves 23 each depressed on the outer periphery of the hollow cylindrical body 21 of the paper bobbin 20. More specifically, one of the two annular grooves 23 is located the place adjacent to one of the two annular protruding portions 22, and the other is adjacent to the other annular protruding portion 22 of the hollow cylindrical body 21, respectively.

Each annular groove 23 is a recess, which depth recessed into the outer periphery of the hollow cylindrical body 21 preferably ranges from 0.5 to 5.5 mm. In addition, each annular groove 23 has a groove width (W) ranging from 4 to 15 mm, preferably from 4 to 12 mm, more preferably from 4 to 8 mm.

When driven by the rotary shaft 40, the paper bobbin 20 of the present invention has different tangential velocities at different positions. At the annular grooves 23, whose inner diameter is smaller than the outer diameter of the hollow cylindrical body 21, a relatively low tangential velocity is obtained at the initial stage of a yarn winding operation.

More specifically, each annular groove 23 formed on the paper bobbin 20 is functionally served as a buffer area when the paper bobbin 20 in winding yarns, so that each annular groove 23 allows yarn to be wound in the buffer area at a relatively low tangential velocity during the initial stage of a yarn winding operation. Thus, the annular grooves 23 keep the paper bobbin 20 from deformation and the yarn being wound from damage attributable to high tension.

Referring to FIG. 3, when the paper bobbin 20 of the present invention is winding with yarn, the paper bobbin 20 is mounted around the stationary shaft 30, and the frictional surface 41 of the rotary shaft 40 is brought into close contact with the top of each protruding portion 22 of the paper bobbin 20. Then, the rotary shaft 40, which serves as a driving shaft, drives the paper bobbin 20 into simultaneous rotation via friction generated by rotation of the frictional surface 41. Once the tangential velocity of the outer periphery of the hollow cylindrical body 21 of the paper bobbin 20 becomes equal to that of the frictional surface 41 of the rotary shaft 40, yarn is introduced into one of the annular grooves 23 of the paper bobbin 20 and subsequently wound around the paper bobbin 20.

According to the above, the paper bobbin 20 of the present invention can lower the frequency of fiber breakage at the initial stage of a yarn winding operation and therefore leads to an increase in quality and yield of yarn.

What is claimed is:

1. A paper bobbin for winding yarn, comprising a hollow cylindrical body of which outer periphery has two identical annular protruding portions spaced apart at a distance and two identical annular grooves spaced apart at a distance;

wherein one of the two identical annular protruding portions is adjacent to one end of the hollow cylindrical body, and the other is adjacent to the other end of the hollow cylindrical body, respectively; and one of the two identical annular grooves is adjacent to one of the two annular protruding portions, the other is adjacent to the other annular protruding portion; and wherein each annular protruding portion is protruded from the outer periphery of the hollow cylindrical body to a height (H) ranging from 0.5 to 2.0 mm and each said annular groove has a width (W) ranging from 4 to 15 mm.

2. The paper bobbin for winding yarn of claim 1, wherein the height (H) of each protruding portion ranges from 0.5 to 1.5 mm and the groove width (W) of each annular groove ranges from 4 to 12 mm.

3. The paper bobbin for winding yarn of claim 1, wherein the height (H) of each protruding portion ranges from 0.8 to 1.2 mm and the groove width (W) of each annular groove ranges from 4 to 8 mm.

* * * * *